United States Patent [19]

Lathers

[11] Patent Number: 4,924,798

[45] Date of Patent: May 15, 1990

[54] RECREATIONAL BOAT DINETTE/SLEEPER

[75] Inventor: Michael W. Lathers, Metamora, Mich.

[73] Assignee: Outboard Marine Corporation, Waukegan, Ill.

[21] Appl. No.: 216,889

[22] Filed: Jul. 8, 1988

[51] Int. Cl.[5] ..... B63B 17/00

[52] U.S. Cl. ..... 114/363; 297/313; 297/337; 108/124

[58] Field of Search ..... 114/71, 188, 189, 343, 114/363, 357; 108/115, 119, 121, 124, 127, 1, 5–7, 11, 12; 5/28, 29, 3; 296/69, 63, 65 R; 297/108, 105, 284, 310, 311, 313, 314, 337, 338

[56] References Cited

U.S. PATENT DOCUMENTS

| | | | |
|---|---|---|---|
| 1,086,232 | 2/1914 | Sedaj | 108/69 |
| 1,182,125 | 5/1916 | Whitehead | 297/313 |
| 1,724,457 | 8/1929 | Cummings | 108/38 |
| 2,787,315 | 4/1957 | Siebert | 114/363 |
| 2,993,529 | 7/1961 | Brown | 114/363 |
| 3,376,587 | 4/1968 | Staron | 114/363 |
| 3,648,628 | 3/1972 | Davis | 108/33 |
| 3,866,547 | 2/1975 | Guyton | 108/38 |
| 4,313,385 | 2/1982 | Fitzgerald | 108/38 |
| 4,529,159 | 7/1985 | Terada | 297/313 |
| 4,709,961 | 12/1987 | Hill | 297/313 |

*Primary Examiner*—Joseph F. Peters, Jr.
*Assistant Examiner*—Clifford T. Bartz
*Attorney, Agent, or Firm*—Michael, Best & Friedrich

[57] ABSTRACT

A marine vehicle comprising a hull, a floor supported by the hull, and a convertible seat/sleeper supported by the floor and including a seat bottom member having a forward end, and a mechanism supporting the seat bottom member for movement between a horizontal position wherein the seat bottom member extends substantially horizontally, and a canted position wherein the seat bottom member is inclined upwardly toward the forward end.

12 Claims, 2 Drawing Sheets

RECREATIONAL BOAT DINETTE/SLEEPER

RELATED APPLICATION

Attention is directed to pending U.S. Ser. No. 216,791, filed concurrently herewith, titled "Recreational Boat Sofa/Sleeper" and assigned to the assignee hereof.

BACKGROUND OF THE INVENTION

The invention relates to recreational boats, and, more particularly, to cabin furniture for such boats. Still more particularly, the invention relates to dinettes and convertible seat/sleepers for recreational boats.

Known convertible seat/sleepers have seat bottom members that are always horizontal. This may be uncomfortable for a person sitting on the horizontal seat bottom member, as the person may tend to slide forwardly off the seat bottom member.

Known dinette arrangements include a table having one end pivotally connected to a wall so that the table is pivotable between a horizontal position and a vertical position.

SUMMARY OF THE INVENTION

The invention provides a marine vehicle comprising a hull, a floor supported by the hull, and a convertible seat/sleeper supported by the floor and including a seat bottom member having a forward end, and means supporting the seat bottom member for movement between a horizontal position wherein the seat bottom member extends substantially horizontally, and a canted position wherein the seat bottom member is inclined upwardly toward the forward end.

The invention also provides a convertible seat/-sleeper comprising a seat bottom member having a forward end, and means supporting the seat bottom member for movement between a horizontal position wherein the seat bottom member extends substantially horizontally, and a canted position wherein the seat bottom member is inclined upwardly toward the forward end.

The invention also provides a seat/sleeper apparatus convertible between a first mode wherein the apparatus forms a pair of spaced-apart, facing seats, and a second mode wherein the apparatus forms a sleeper, the apparatus comprising first and second seat bottom members having respective forward and rearward ends, the forward ends being spaced apart to define therebetween a gap, means supporting the first seat bottom member for movement between a horizontal position wherein the first seat bottom member extends substantially horizontally, and a canted position wherein the first seat bottom member is inclined upwardly toward the forward end of the first seat bottom member, means supporting the second seat bottom member for movement between a horizontal position wherein the second seat bottom member extends substantially horizontally, and a canted position wherein the second seat bottom member is inclined upwardly toward the forward end of the second seat bottom member, first and second seat back members removably supported above the rearward ends of the first and second seat bottom members, respectively, when the apparatus is in the first mode, and means for supporting at least one of the seat back members across the gap when the apparatus is in the second mode.

The invention also provides a table apparatus comprising a main table portion having an underside and an end adapted to be located adjacent a wall, a mounting member having opposite first and second ends, means connecting the first end of the mounting member to the wall for pivotal movement about a first generally horizontal axis, and means connecting the second end of the mounting member to the underside of the main table portion for pivotal movement about a second axis generally parallel to the first axis, the main table portion being moveable between a first position wherein the main table portion and the mounting member extend generally horizontally with the mounting member facing the underside of the main table portion, and a second position wherein the main table portion and the mounting member extend generally vertically, wherein the mounting member extends upwardly from the first axis and wherein the mounting member is located between the underside of the main table portion and the wall.

The invention also provides a marine vehicle comprising a hull, a wall supported by the hull, and a table apparatus including a main table portion having an underside and an end adapted to be located adjacent the wall, a mounting member having opposite first and second ends, means connecting the first end of the mounting member to the wall for pivotal movement about a first generally horizontal axis, and means connecting the second end of the mounting member to the underside of the main table portion for pivotal movement about a second axis generally parallel to the first axis, the main table portion being moveable between a first position wherein the main table portion and the mounting member extend generally horizontally with the mounting member facing the underside of the main table portion, and a second position wherein the main table portion and the mounting member extend generally vertically, wherein the mounting member extends upwardly from the first axis and wherein the mounting member is located between the underside of the main table portion and the wall.

A principal feature of the invention is the provision of a convertible seat/sleeper comprising a seat bottom member having a forward end, and means supporting the seat bottom member for movement between a horizontal position wherein the seat bottom member extends substantially horizontally, and a canted position wherein the seat bottom member is inclined upwardly toward the forward end.

Another principal feature of the invention is a seat/-sleeper apparatus comprising two seat/sleepers as described above, the forward ends of the seat bottom members being spaced apart to define therebetween a gap, first and second seat back members removably supported above the rearward ends of the first and second seat bottom members, respectively, when the apparatus is in a first mode, and means for supporting at least one of the seat back members across the gap when the apparatus is in a second mode.

Another principal feature of the invention is the provision of a table apparatus comprising a main table portion having an underside and an end adapted to be located adjacent a wall, a mounting member having a first and connected to the wall for pivotal movement about a first generally horizontal axis, and a second end connected to the table portion for pivotal movement about a second axis generally parallel to the first axis, the main table portion being movable between a first position wherein the main table portion and the mounting member extend generally horizontally with the mounting member facing the underside of the main table portion, and a second position wherein the main table portion and the mounting member extend generally vertical, wherein the mounting member extends upwardly from the first axis and wherein the mounting member is located between the underside of the main table portion and the wall.

Other features and advantages of the invention will become apparent to those skilled in the art upon review of the following detailed description, claims and drawings.

Figure 1:
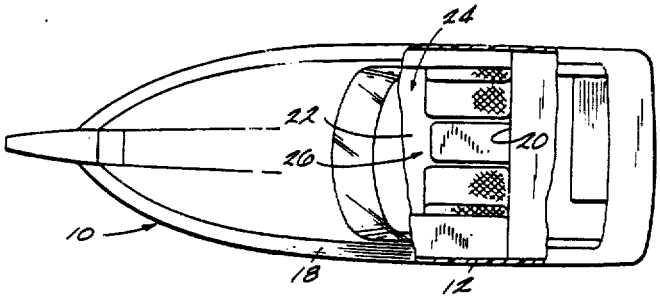
FIG. 1 is a plan view of a boat embodying the invention and including a dinette/sleeper. The dinette/sleeper includes a seat/sleeper apparatus and a table apparatus.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried cut in various ways. Also, it is to be understood that the phraseology and terminology used herein is for the purpose of description and should not be regarded as limiting.

DESCRIPTION OF THE PREFERRED EMBODIMENT

A recreational boat or marine vehicle 10 embodying the invention is illustrated in the drawings. The boat 10 comprises a hull 12, and a plurality of hull stringers 14 extending upwardly from and supporting the hull 12. The upper ends of two of the hull stringers 14 define supporting surfaces 16. The boat 10 also comprises a top deck member 18, a cabin wall 20 and a cabin floor 22 defining a cabin 24.

Figure 3:
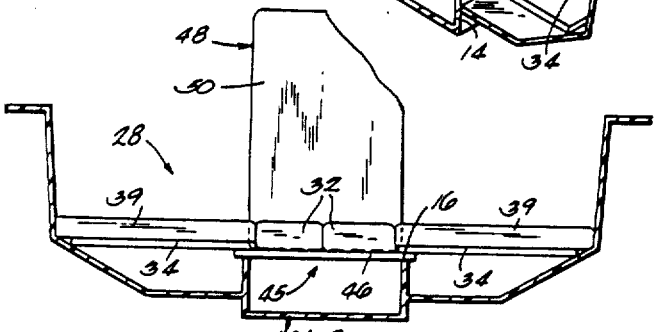
FIG. 3 is an elevational view of the dinette/sleeper in its sleeping mode.
Figure 5:
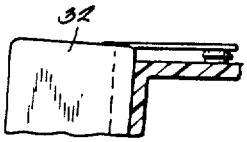
FIG. 5 is a partial, elevational view of a seat back member of the seat/sleeper apparatus.
Figure 4:
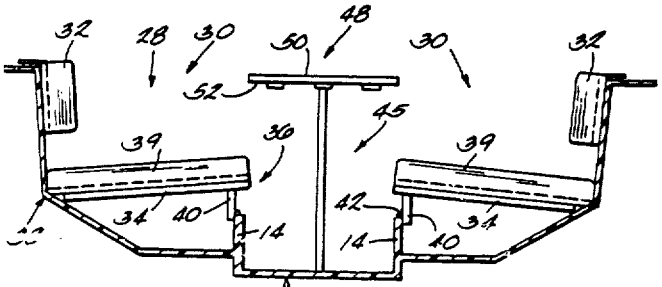
FIG. 4 is an elevational view of the dinette/sleeper in its dining mode.

The boat 10 also comprises a dinette/sleeper 26 located in the cabin 24. The dinette/sleeper 26 includes a seat/sleeper apparatus 28 convertible between a first mode (FIG. 4) wherein the apparatus 28 forms a pair of spaced apart, facing seats, and a second mode (FIG. 3) wherein the apparatus 28 forms a sleeper or bed. The seat/sleeper apparatus 28 comprises a pair of spaced apart, facing seats 30 that are substantially identical and that have been given the same reference numerals.

Each seat 30 includes a seat back member 32. In the preferred embodiment, the seat back member 32 includes a cushion mounted on a piece of plywood. The seat 30 also includes a seat bottom member 34 having forward and rearward ends 36 and 38, respectively. The rearward end 38 of the seat bottom member 34 is located beneath the seat back cushion 32 when the apparatus 28 is in its first or dining mode. Thus, the seat back member 32 is removably supported above the rearward end 38 of the seat bottom member 34 when the seat/sleeper apparatus 28 is in its first mode. The seat 30 also includes a seat bottom cushion 39 supported by the seat bottom member 34.

Figure 6:
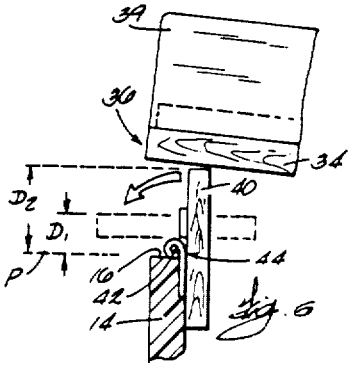
FIG. 6 is an enlarged, partial, elevational view of the seat/sleeper apparatus.
Figure 7:
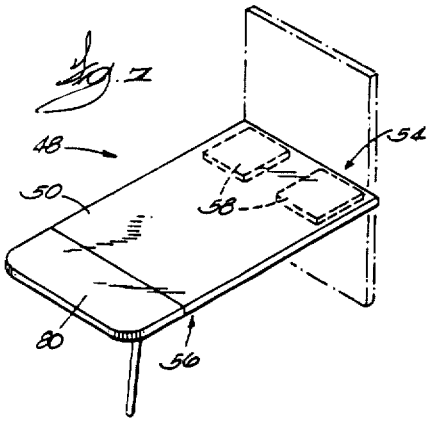
FIG. 7 is a perspective view of the table apparatus.

The seat 30 also includes means supporting the seat bottom member 34 for movement between a horizontal position wherein the seat bottom member 34 extends substantially horizontally, and a canted position wherein the seat bottom member 34 is inclined upwardly toward its forward end 36. While various suitable supporting means can be employed, in the preferred embodiment, such means includes (see FIG. 6) means selectively and alternatively operable for supporting the forward end 36 of the seat bottom member 34 a first distance $D_1$ above a generally horizontal reference plane P and for supporting the forward end 36 of the seat bottom member 34 a second distance $D_2$ above the plane P. As shown in FIG. 6, the second distance $D_2$ is greater than the first distance $D_1$. The seat bottom member 34 is in its horizontal position when the forward end of the seat bottom member 34 is spaced the first distance $D_1$ above the plane P and is in its canted position when the forward end of the seat bottom member 34 is spaced the second distance $D_2$ above the plane P. Also, the plane P includes the supporting surface 16.

While various suitable selectively operable means can be used, in the illustrated construction, such means includes a support member 40 located at least partially beneath the forward end of the seat bottom member 34 and having a length (the vertical dimension in FIG. 6), and a thickness (the horizontal dimension in FIG. 6) less than the length. As shown in the drawings, the forward end of the seat bottom member 34 rests on the support member 40. The selectively operable means also includes means supporting the support member 40 for movement between a first position wherein the thickness extends vertically and the support member 40 extends the first distance $D_1$ above the plane P, and a second position wherein the length extends vertically and the support member 40 extends the second distance $D_2$ above the plane P. While various suitable supporting means can be employed, in the preferred embodiment, the means supporting the support member 40 includes means connecting the support member 40 to the hull stringer 14 for pivotal movement about a generally horizontal axis 42. Preferably, this means includes a conventional hinge assembly 44 (FIG. 6).

An alternative arrangement for supporting the seat bottom member 34 is disclosed in the above-cited application titled "Recreational Boat Sofa/Sleeper," which is hereby incorporated herein by reference.

Figure 2:
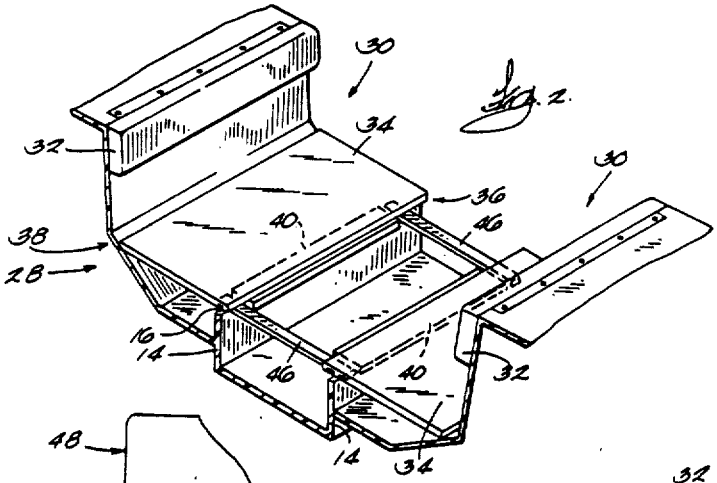
FIG. 2 is a perspective view of the seat/sleeper apparatus.

The seat/sleeper apparatus 28 further includes means for supporting at least one of the seat back members 32 across the gap 45 (FIGS. 3 and 4) defined by the seats 30 when the apparatus 28 is in its second mode, i.e., when the apparatus 28 is being used as a sleeper. While various suitable supporting means can be employed, in the preferred embodiment, the supporting means includes the support members 40. More particularly, as shown in FIGS. 2 and 6, each support member 40 extends outwardly of the associated seat bottom member 34 when the support member 40 is in its first position. Thus, the support member 40 forms a ledge extending outwardly from beneath the forward end 36 of the associated seat bottom member 34. The means for supporting the seat back members 32 across the gap also includes a pair of elongated support members or slats 46 removably supported across the gap. More particularly, as shown in the drawings, the opposite ends of the slats 46 are positioned on the supporting surfaces 16, and the slats 46 are located at the opposite ends of the support members 40. Furthermore, the slats 46 have thicknesses substantially equal to the thicknesses of the support members 40 so that the ends of the slats 46 fit snugly between the supporting surfaces 16 and the seat bottom members 34 when the seat bottom members 34 are in their horizontal positions.

Figure 8:
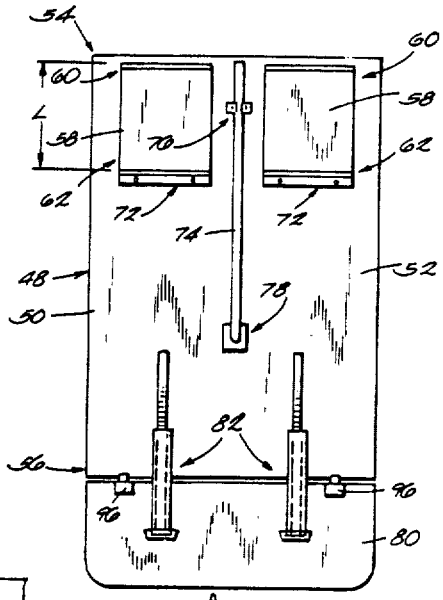
FIG. 8 is a plan view of the underside of the main table portion of the table apparatus.
Figure 13:
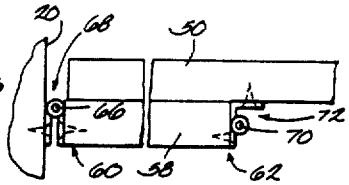
FIG. 13 is an enlarged, partial, elevational view of the table apparatus.

The dinette/sleeper 26 also comprises (see FIGS. 3, 4 and 7–13) a table apparatus 48 including a main table portion 50 having an underside 52 and inner and outer ends 54 and 56, respectively. The table apparatus 48 also includes a pair of mounting members 58 each having opposite first and second ends 60 and 62, respectively, and a length L (FIG. 8).

The table apparatus 48 also includes (see FIG. 13) means connecting the first end 60 of the first mounting member 58 to the wall 20 for pivotal movement about a first generally horizontal axis 66, and means connecting the first end 60 of the second mounting member 58 to the wall 20 for pivotal movement about the first axis 66. While various suitable connecting means can be used, in the illustrated construction, such means include conventional hinge apparatus 68.

The table apparatus 48 also includes (see FIG. 13) means connecting the second end 62 of the first mounting member 58 to the underside 52 of the main table portion 50 for pivotal movement about a second axis 70 generally parallel to the first axis 66, and means connecting the second end 62 of the second mounting member 58 to the underside 52 of the main table portion 50 for pivotal movement about the second axis 70. While various suitable connecting means can be employed, in the preferred embodiment, such means include conventional hinge apparatus 72.

The main table portion 50 is movable between a first or extended position (FIG. 9) wherein the main table portion 50 and the mounting members 58 extend generally horizontally with the mounting members 58 facing the underside of the main table portion 50, and a second or retracted position (FIG. 12) wherein the main table portion 50 and the mounting members 58 extend generally vertically, wherein the mounting members 58 extend upwardly from the first axis 66 and wherein the mounting members 58 are located between the underside 52 of the main table portion 50 and the wall 20.

Figure 9:
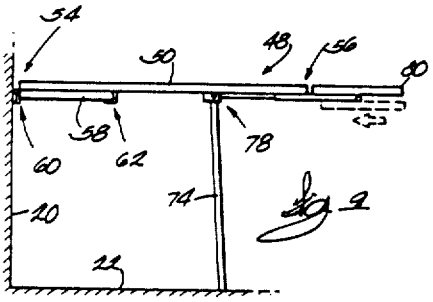
FIG. 9 is an elevational view of the table apparatus with the main table portion in its horizontal position.
Figure 10:
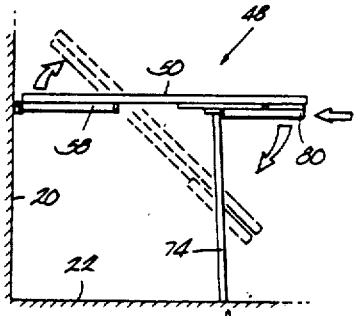
FIGS. 10–12 are views similar to FIG. 9 and illustrate movement of the main table portion to its vertical position.
Figure 11:
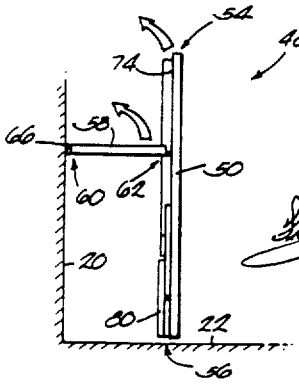
Figure 12:
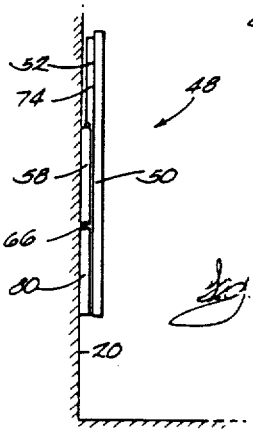

The table apparatus 48 further comprises a support leg 74 connected to the underside 52 of the main table portion 50 and movable between a retracted position (FIGS. 8, 11 and 12) wherein the support leg 74 lies against the underside of the main table portion 50, and an extended position (FIGS. 9 and 10) wherein the support leg 74 extends generally perpendicular to the main table portion 50 and supports the main table portion 50 above the floor 22. Suitable clip means 76 (FIG. 8) are provided for releasably maintaining the support leg 74 in its retracted position. In the preferred embodiment, the support leg 74 is pivotally movable between its retracted and extended positions, and the upper end of the support leg 74 is pivotally connected to the underside of the main table portion 50 by a conventional hinge apparatus 78 (FIGS. 8 and 9).

The table apparatus 48 further includes a table extension portion 80, and means connecting the table extension portion 80 to the outer end 56 of the main table portion 50 for movement between a first or retracted position (FIGS. 10–12) wherein the extension portion 80 is located adjacent the underside 52 of the main table portion 50 and inwardly of the outer end 56, and a second or extended position (FIGS. 7–9) wherein the extension portion 80 is substantially coplanar with the main table portion 50 and is located outwardly of the outer end 56 of the main table portion 50. While various suitable connecting means can be employed, in the illustrated construction, such means includes (see FIG. 8) a pair of conventional slide hinges 82. Selectively releasable clips 96 (FIG. 8) are provided for releasably securing the extension portion 80 in its extended and retracted positions. The extension portion 80 is moved from its extended position to its retracted position by releasing the clips 96, rotating the extension portion 80 180° about the ends of the slide hinges 94, and sliding the extension portion 80 beneath the outer end 56 of the table portion 50.

As shown in the drawings, the extension portion 80 is moved to its retracted position before the main table portion 50 is moved to its second position, and the extension portion 80 is located between the underside 52 of the main table portion 50 and the wall 20 when the main table portion 50 is in the second position.

Various features of the invention are set forth in the following claims.

I claim:

1. Apparatus convertible between a first mode wherein said apparatus forms a pair of spaced-apart, facing seats, and a second mode wherein said apparatus forms a sleeper, said apparatus comprising first and second seat bottom members having respective forward and rearward ends, said forward ends being spaced apart to define therebetween a gap, means supporting said first seat bottom member for movement between a horizontal position wherein said first seat bottom member extends substantially horizontally, and a canted position wherein said first seat bottom member is inclined upwardly toward said forward end of said first seat bottom member, means supporting said second seat bottom member for movement between a horizontal position wherein said second seat bottom member extends substantially horizontally, and a canted position wherein said second seat bottom member is inclined upwardly toward said forward end of said second seat bottom member, first and second seat back members removably supported above said rearward ends of said first and second seat bottom members, respectively, when said apparatus is in said first mode, and means for supporting at least one of said seat back members across said gap when said apparatus is in said second mode.

2. Apparatus as set forth in claim 1 wherein said means supporting said first seat bottom member includes a first support member located at least partially beneath said forward end of said first seat bottom member, and means supporting said first support member for movement between a first position wherein said first seat bottom member is substantially horizontal when said forward end of said first seat bottom member is resting on said first support member, and a second position wherein said first seat bottom member is inclined upwardly toward said first support member when said forward end of said first seat bottom member is resting on said first support member, and wherein said means supporting said second seat bottom member includes a second support member located at least partially beneath said forward end of said second seat bottom member, and means supporting said second support member for movement between a first position wherein said second seat bottom member is substantially horizontal when said forward end of said second seat bottom member is resting on said second support member, and a second position wherein said second seat bottom member is inclined upwardly toward said second support member when said forward end of said second seat bottom member is resting on said second support member.

3. Apparatus as set forth in claim 2 wherein said means for supporting at least one of said seat back members across said gap includes said first and second support members.

4. Apparatus as set forth in claim 2 wherein said means for supporting at least one of said seat back members includes an elongated support member removably supported across said gap.

5. Apparatus as set forth in claim 4 wherein said elongated member has a thickness substantially equal to said thicknesses of said first and second support members.

6. Apparatus as set forth in claim 1 and further comprising a main table portion having an underside and an end adapted to be located adjacent a wall, a mounting member having opposite first and second ends, means connecting said first end of said mounting member to the wall for pivotal movement about a first generally horizontal axis, and means connecting said second end of said mounting member to said underside of said main table portion for pivotal movement about a second axis generally parallel to said first axis, said main table portion being movable between a first position wherein said main table portion and said mounting member extend generally horizontally with said main table portion above said gap and with said mounting member facing said underside of said main table portion, and a second position wherein said main table portion and said mounting member extend generally vertically, wherein said mounting member extends upwardly from said first axis and wherein said mounting member is located between said underside of said main table portion and the wall.

7. A marine vehicle comprising a hull, a floor supported by said hull, and apparatus supported by said hull, convertible between a seat and a sleeper and including a bottom member having an end, and means supporting said bottom member for movement between a horizontal position wherein said bottom member extends substantially horizontally, and canted position wherein said bottom member is inclined upwardly toward said end, said means supporting said bottom member including a support member located at least partially beneath said end of said bottom member for supporting engagement with said end, and having a thickness and a length dimension greater than said thickness, and means supporting said support member for movement between a first position wherein said thickness extends vertically and a second position wherein said length dimension extends vertically.

8. A marine vehicle as set forth in claim 7 and further comprising a hull stringer extending upwardly from said hull, and wherein said support member is mounted on said hull stringer for movement between said first and second positions.

9. Apparatus convertible between a seat and a sleeper, which apparatus comprises a bottom member having an end, and means supporting said bottom member for movement between a horizontal position wherein said bottom member extends substantially horizontally, and a canted position wherein said bottom member is inclined upwardly toward said end, said means supporting said bottom member including a support member located at least partially beneath said end of said bottom member for supporting engagement with said end, said support member having a thickness, and a greater length dimension than said thickness, and means supporting said support member for movement between a first position wherein said thickness extends vertically, and a second position wherein said length dimension extends vertically.

10. Apparatus as set forth in claim 9 wherein said end is adapted to be supported above a generally horizontal reference plane, and wherein said bottom member supporting means includes means selectively and alternatively operable for supporting said end a first distance above the plane and for supporting said end a second distance above the plane.

11. Apparatus convertible between a seat and a sleeper, which apparatus comprises a bottom member having an end, and means supporting said bottom member for movement between a horizontal position wherein said bottom member extends substantially horizontally, and a canted position wherein said bottom member is inclined upwardly with said end located above the location of said end when said bottom member extends horizontally, said bottom member supporting means including means selectively and alternatively operable for supporting said end when said bottom member is in said horizontal and canted positions, said selectively operable means including a support member located at least partially beneath said end of said bottom member, and means supporting said support member for movement between a first position wherein said end removably rests on said support member, without being fastened to said support member, when said bottom member is in the horizontal position, and a second position wherein said end removably rests on said support member, without being fastened to said support member, when said bottom member is in the canted position.

12. A marine vehicle comprising a hull, a floor supported by said hull, a generally horizontal reference plane, and an apparatus supported by said floor and convertible between a seat and a sleeper, said apparatus including a seat bottom member having a forward end adapted to be supported above said plane, and means supporting said seat bottom member for movement between a horizontal position wherein said seat bottom member extends substantially horizontally, and a canted position wherein said seat bottom member is inclined upwardly toward said forward end, said supporting means including means selectively and alternatively operable for supporting said forward end a first distance above said plane and for supporting said forward end a second distance above said plane, said second distance being greater than said first distance, said selectively operable means including a support member located at least partially beneath said forward end of said seat bottom member, and means supporting said support member for movement between a first position wherein said support member extends said first distance above said plane and wherein said forward end rests on said support member without being fastened to said support member and a second position wherein said support member extends said second distance above said plane and wherein said forward end rests on said support member without being fastened to said support member.

* * * * *